US005710358A

United States Patent [19]

Yang et al.

[11] Patent Number: 5,710,358

[45] Date of Patent: Jan. 20, 1998

[54] OXIDATIVE DETOXIFICATION OF PHOSPHONOTHIOLATES AND PHOSPHONOTHIOIC ACIDS

[75] Inventors: Yu-Chu Yang; John B. Samuel; William T. Beaudry; Linda L. Szafraniec, all of Bel Air, Md.; Clifford A. Bunton, Santa Barbara, Calif.

[73] Assignee: The United States of America as represented by the Secretary of the Army, Washington, D.C.

[21] Appl. No.: 687,065

[22] Filed: Jul. 8, 1996

[51] Int. Cl.[6] ..... A62D 3/00

[52] U.S. Cl. ..... 588/200; 210/758

[58] Field of Search ..... 588/200; 210/758, 210/759

[56] References Cited

U.S. PATENT DOCUMENTS

| | | | |
|---|---|---|---|
| 3,810,788 | 5/1974 | Steyermank | 588/200 |
| 4,666,696 | 5/1987 | Shultz | 423/659 |
| 5,252,224 | 10/1993 | Modell et al. | 210/695 |
| 5,430,228 | 7/1995 | Ciambrone et al. | 588/200 |
| 5,574,202 | 11/1996 | Pilipski | 588/200 |
| 5,584,071 | 12/1996 | Kalyon et al. | 588/200 |

OTHER PUBLICATIONS

Yang, Y.C., et al; Oxidative Detoxification of Phosphonothiolates, J. Am. Chem. Soc. (1990), 112(18), 66 21–7.

*Primary Examiner*—Ngoclan Mai

*Attorney, Agent, or Firm*—Ulysses John Biffoni

[57] ABSTRACT

A method for detoxifying substituted and unsubstituted phosphonothiolates and phosphonothioic acids. The method requires reacting the phosphonothiolate or phosphonothioic acid with a sufficient amount of a compound containing an $HSO_5$-ion, for a sufficient time and under conditions sufficient to produce a reaction product having less toxicity than the phosphonothiolate or phosphonothioic acid. The preferred compound containing an $HSO_5$-ion is potassium monopersulfate, $2KHSO_5.KHSO_4.K2S0_4$.

14 Claims, No Drawings

OXIDATIVE DETOXIFICATION OF PHOSPHONOTHIOLATES AND PHOSPHONOTHIOIC ACIDS

GOVERNMENT INTEREST

The invention described herein may be manufactured, used, or licensed by or for the United States Government.

BACKGROUND OF THE INVENTION

1. Field of the Invention

This invention relates to the oxidative detoxification of phosphonothiolates. More particularly, the invention pertains to an improved means of decontaminating phosphonothiolates and phosphonothioic acids.

2. Description of the Prior Art

Phosphonothiolates are highly toxic chemical warfare nerve agents first synthesized in the mid 1950's and currently stockpiled by various governments. The most commonly known of these nerve agents is O-ethyl S-(2-diisopropylamino)ethyl methylphosphonothiolate which is known as VX. Although phosphonothiolates and their toxic hydrolysis products phosphonothioic acids, have been known for decades, only limited information on the detoxification of bulk quantities of these agents exists. Methods used over the years to decontaminate such agents have each had problems associated with them such as low solubility of the agent, toxicity, corrosiveness, hazardous reaction products or the generation of large amounts of waste products. Most of the toxic organophosphorus esters can be detoxified by hydrolysis in alkaline solutions. See O'Brien, R. D., Toxic Phosphorus Esters; Academic Press, London, 1960, Chapter 2; and Jenks, W. P., et al, J. Am. Chem. Soc. 1964, 86, pgs. 5616–5620. However, relative to the chloro or fluorophosphonates, the hydrolysis of phosphonothiolate esters is slow even at very high pH values. See DeBruin, K. E., et al, A. Am. Chem. Soc. 1989, 111, pgs 5871–5879; and Epstein, J., et al, Phosphorus Relat. Group V Elem., 1974, 4, pgs 157–163. The estimated half-life for the spontaneous hydrolysis of the nerve agent VX is 80 hours at 20° C. Multiple hydrolysis pathways have been reported. VX hydrolyses via simultaneous cleavage of the P—S, S—C and P—O bonds forming several products. Although the ethyl methylphosphonic acid and the O-ethyl methylphosphonothioic acid products are relatively non-toxic, other products are almost as toxic as VX. Although it has been reported that VX hydrolyses via a single reaction pathway at pH values greater than 10, toxic by-products preclude base-catalyzed hydrolysis as an effective method for detoxification of VX.

The standard Army decontaminant, DS2 (70% diethylenetriamine, 28% methyl cellosolve, 2% NaOH, by weight) is used to detoxify VX under combat conditions. While extremely effective at destroying the agent via nucleophilic substitution using alkoxide ion, DS2 has deleterious effects on many materials. See Beaudry, W. T., et al "Reactions of Chemical Warfare Agents with DS2: Product Identification by NMR. I. Organophosphorus Compounds". CRDEC-TR-364, Jun. 1992. In addition, because of its corrosive nature on exposure to air, DS2 is considered to be a hazardous material, and any resulting solutions are classified as hazardous waste and must be regulated in accordance with the Resource Conservation and Recovery Act. Consequently, the use of DS2 to detoxify small quantities of VX as well as its use in the large-scale demilitarization of leaking and/or obsolete agent-filled munitions is undesirable since it would generate large quantities of regulated hazardous waste.

An existing small-scale laboratory method to detoxify VX to form a non-hazardous waste uses an aqueous solution/slurry of calcium hypochlorite. To assure that all of the VX is destroyed, the method calls for 8.25 moles of the oxidant Ca(OCl)2 per mole of VX. The large excess of oxidant is required because the solution is basic. Consequently, the amino nitrogen on the VX is available for oxidation and consumes a significant amount of the hypochlorite before all of the VX can be detoxified. Based on a 20% mixture of 55% calcium hypochlorite in water, 80 ml of calcium hypochlorite solution are required per ml of VX. In addition, the overall process is slow because VX has a very low solubility in the basic calcium hypochlorite solution. This method uses a very corrosive decontaminant to oxidize VX, producing a variety of nontoxic products. In addition, this method produces a large quantity of waste per gram of VX. Because of the active chlorine, both the decontaminating solution and the product are corrosive to certain metals.

An existing large-scale method for VX detoxification (>50 g) uses an alcoholic (ethanol) aqueous calcium hypochlorite solution (HTH) to dissolve the VX and to oxidize about 65% of the agent. This is followed by the relatively slow hydrolysis of the remaining VX under basic conditions. One hour after the agent is added to the alcoholic HTH solution, aqueous NaOH is added to bring the solution to a pH >12.5. At the end of 24 hrs, all of the VX is destroyed; however, ca. 4–8% of the VX is typically converted by basic hydrolysis to the toxic phosphonothoic acid. For these solutions, it was found that to hydrolyze the toxic product to an acceptable level, the material has to be held for 60 days at pH 12.5 at ambient temperature. After this holding period, the product is neutralized to below pH 12, and the material is classified as a non-hazardous waste.

It has now been found that phosphonothiolates and phosphonothioic acids can be quickly, easily and safely detoxified using a solution of a persulfate salt, i.e. a salt having a $HSO_5$-ion. The most preferred persulfate salt is potassium monopersulfate which is available as a component of OXONE, $2KHSO_5.KHSO_4.K_2SO_4$from the DuPont Company. This method uses a nearly saturated aqueous solution of potassium monopersulfate to dissolve and oxidize phosphonothiolates and phosphonothioic acids into nontoxic products. The OXONE solution provides a buffer at pH 2 which provides high solubility for the phosphonothiolates.

SUMMARY OF THE INVENTION

The invention provides a method of detoxifying phosphonothiolates and phosphonothioic acids which comprises reacting a composition comprising a phosphonothiolate or phosphonothioic acid with a sufficient amount of a compound containing an $HSO_5$-ion, for a sufficient time and under conditions sufficient to produce a reaction product having less toxicity than the phosphonothiolate or phosphonothioic acid.

DETAILED DESCRIPTION OF THE PREFERRED EMBODIMENT

The invention provides a procedure for detoxifying phosphonothiolates and phosphonothioic acids and including substituted phosphonothiolates and phosphonothioic acids. Such non-exclusively include O-ethyl S-(2-diisopropylamino)ethyl methylphosphonothiolate; O-isobutyl S-(2-diethyl)ethyl methylphosphonothiolate; O,S-diethyl methylphosphonothiolate and S-(2-diisopropylamino)ethyl methylphosphonothioic acid. The phosphonothiolates, phosphonothioic acids and substituted phosphonothiolates and phosphonothioic acids are detoxified by reaction with a sufficient amount of a compound containing an $HSO_5$-ion, for a sufficient time and under conditions sufficient to produce a reaction product having less toxicity than the substituted or unsubstituted phosphonothiolate or phosphonothioic acid. In the preferred embodiment, the compound containing an $HSO_5$-ion is present in solution, preferably an aqueous solution. Preferably, the compound containing the $HSO_5$-ion is reacted with the substituted or unsubstituted phosphonothiolate or phosphonothioic acid in an amount to provide at least three molar equivalents of active oxygen per molar equivalent of the substituted or unsubstituted phosphonothiolate or phosphonothioic acid. In the preferred embodiment, the compound containing an $HSO_5$-ion is a salt of an alkali or alkaline earth metal, or ammonium monopersulfate and more preferably potassium or sodium monopersulfate. When the monopersulfate is the acid itself ($H_2SO_5$), it may be prepared in situ during the reaction by pre-reacting sulfuric acid and hydrogen peroxide.

The most preferred monopersulfate is potassium monopersulfate which is commercially available from DuPont Company as OXONE, which is $2KHSO_5.KHSO_4.K_2SO_4$.

Each formula weight of OXONE (615 g) contains two moles of the active ingredient, potassium monopersulfate ($KHSO_5$), with each mole of $KHSO_5$ containing one active oxygen. Three active oxygens are required to oxidize one mole of VX as shown in equation (1), below:

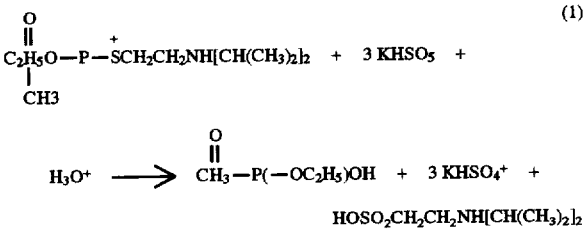

(1)

Under these acidic conditions, VX is soluble and the nitrogen in VX is protonated and not available for oxidation. Detoxification is achieved by oxidation preferably followed by hydrolysis at the P—S bond forming the phosphonic and sulfonic acids.

Using the OXONE procedure, VX is quickly dissolved with minimal stirring, resulting in a homogeneous solution. The pH of the solution remains constant and does not increase in the presence of VX. Once dissolved, VX is oxidized by the active oxygen and converted to nontoxic products; at 24 hrs after mixing, no VX is detected. The reaction product, once neutralized to pH 7, shows no toxic effects. The neutralized product is considered a non-hazardous waste. In addition, the aqueous OXONE solution is not as corrosive to metals as DS2 or the calcium hypochlorite solutions, and results in 60% less liquid waste than the currently approved delisted method for laboratory quantities (<50 g) of VX. This exemplified procedure is applicable to other phosphonothiolates and phosphonothioic acids and including substituted phosphonothiolates and phosphonothioic acids with minor adjustments to concentrations, mixing and reaction times, all of which may be easily determined by those skilled in the art.

The following non-limiting examples serve to illustrate the invention.

EXAMPLE 1

A solution of 5 g of OXONE and 20 g of water is prepared for each 1 g of VX to be decontaminated. This ratio is based on 87% active OXONE which equates to 3.78 moles potassium monopersulfate per mole of VX. These quantities provide for about a 25% excess $KHSO_5$ which assures the complete destruction of the agent. Once the OXONE is dissolved, the VX is added with mixing. Continue mixing until a homogeneous solution is obtained. Allow the solution to stand for 24 hrs after the VX has been added. After 24 hrs, conduct an iodide test to assure that all the active oxygen was not consumed. Using NaOH, adjust the pH to ca. 7. The material should then be considered a non-hazardous waste.

For other phosphonothiolates, adjust the quantity of OXONE used to assure 3.75 moles of $KHSO_5$ per mole of P—SR bonds present. Assure adequate mixing; analyze the final reaction product to assure complete destruction. Adjust the reaction time and the concentrations as required.

EXAMPLE 2

An aqueous solution of O,S-diethyl methylphosphonothiolate and OXONE (0.036M O,S-diethyl methylphosphonothiolate and 0.048M $KHSO_5$) was prepared in a 5-mm NMR tube. In five minutes, $^{31}P$ NMR indicated 50% of the phosphonothiolate was destroyed.

EXAMPLE 3

An aqueous solution of VX and OXONE (0.029M of VX and 1.2M of $KHSO_5$) was prepared in a 5-mm NMR tube. $^{31}P$ NMR indicated that all of the VX was destroyed in less than two minutes.

EXAMPLE 4

An aqueous solution of VX and OXONE (0.061 M of VX and 0.21M of $KHSO_5$) was prepared in a 5-mm NMR tube. $^{31}P$ NMR indicated that the half-life of the VX was about 2 minutes. NMR and mass spectrometry showed that the products were ethyl methylphosphonic acid and diisopropylaminoethyl sulfonic acid.

EXAMPLE 5

A solution containing 4.61 g of 87% active OXONE (0.01249 moles of potassium monopersulfate) in 26.43 g of distilled water was placed in a 125 ml Erlenmeyer flask at room temperature. One ml of VX of 90% purity (0.00375 moles uncorrected for purity) was added with stirring. The VX dissolved rapidly forming a colorless solution. The flask became warm but the reaction did not appear to be violent. Stirring was continued for 55 minutes followed immediately by sampling and analysis by $^{31}P$ NMR. No VX was detected. The mole ratio of the monopersulfate to VX was 3.3 to 1 (uncorrected for the VX purity).

EXAMPLE 6

A concentrated OXONE solution was prepared in a 125 ml Erlenmeyer flask by dissolving 12 g of 87% active OXONE (0.034 moles potassium monopersulfate) in 41 g of distilled water. Once the solution came to room temperature, 3 g of CASARM grade VX (>95% pure) were added with mixing using a magnetic stirring bar. The VX dissolved rapidly and reacted vigorously with the solution becoming hot and evolving some vapor. Several minutes after the agent was added, the temperature was determined to be 68° g C. A single liquid phase was quickly established and the stirring was stopped. On cooling, some crystals precipitated from solution. Additional water (6.5 ml) was added with stirring until all the crystals dissolved. A 0.5 ml sample was withdrawn for analysis by $^{31}P$ NMR 30 minutes into the reaction. Analysis indicated that 3.3 mole % VX was unreacted, with the remaining phosphorus compounds consisting of 0.4 mole % S-2-(diisopropylamino)ethyl methylphosphonothioic acid and 96.3 mole % phosphonic acids, phosphonates, and phosphinates. At 1 hour into the reaction, an iodide test was conducted for active oxygen. About 0.5 ml of the decontaminated solution (pH ca 1.2) was added to a solution made from one crystal of sodium iodide and 0.5 ml water. A negative result was obtained (an immediate iodine red color did not appear) which indicated that all active oxygen had been depleted. A second NMR analysis performed at about 19 hours after mixing showed that 3.1 mole % VX and 0.1 mole % other toxic by-products. A ratio of 3.0 moles of potassium monopersulfate to 1 mole of VX was used. However, the solution was about 3% deficient in the potassium monopersulfate. The deficiency in potassium monopersulfate was likely due to experimental error in VX delivery or to consumption of additional active oxygen by some of the impurities in the VX. At about 24 hours into the test, 5% additional OXONE (0.6 g) was added to react with the remaining VX. The OXONE was added with mixing along with additional water to dissolve the solid. The total quantity of water was brought to 59 g. One hour after the OXONE/water addition, the iodide test was repeated. A definite positive result was obtained.

Thirty minutes after the OXONE addition, the sample was analyzed again by NMR. Both the VX and toxic by-product resonances were reduced but still present. After reacting overnight, NMR analysis indicated no VX or toxic by-products present. Once all of the VX and toxic by-products were destroyed, the pH was adjusted upward by slowly adding 1.33 g of solid NaOH pellets and 24 ml of 1N aqueous NaOH. With each addition, the pH would rise then drift partially back down. Some off-bubbling of gas occurred during the NaOH addition, particularly above pH 3, indicating the release of the remaining active oxygen. After the final addition of NaOH, the pH appeared to stabilize at 3.4. However, within 24 hrs, the pH had dropped to 3.15. The mole ratio of the total potassium monopersulfate to VX added was 3.2 based on the materials added and tabulated below:

VX 3.1 g

OXONE 12.6 g (87% pure based on active oxygen)

NaOH 2.3 g

Water 82.0 g

A waste profile analysis and gas chromatographic (GC) analysis were run on the final sample. The waste profile results were negative except that phosphorus and an oxidizer were noted as being present. Initial extraction and analysis of the product by GC indicated the possibility of VX at a level of 0.04 micrograms/ml (40 ppb) of solution. A follow-up extraction and analysis showed no VX present.

EXAMPLE 7

This procedure provides for additional water to absorb heat and uses roughly a 25% excess of OXONE. The excess OXONE was provided to assure complete destruction of the VX and to allow for unknown impurities in the sample. This procedure requires 5 g of OXONE and 20 g of water per ml of VX to be decontaminated. This quantity is based on 87% active OXONE and equates to 3.78 moles of potassium monopersulfate per 1 mole of VX (which includes 25% excess potassium monopersulfate). This procedure also requires stirring the solution until all of the VX is added. The iodide test assures that all active oxygen is not consumed. 255 g of 87% active OXONE and 1021 g of distilled water were added to a 2 L bottle. The material was stirred for several minutes using a magnetic stirring bar until all of the OXONE dissolved. A 50 ml glass syringe with a 12 inch 10 gauge blunt needle was used to add 51 ml of CASARM VX (>95% pure) in 37.5 and 13.5 ml aliquots below the liquid surface. Stirring was continued for 15 minutes after the final agent was added. The resulting mixture was a single phase, colorless liquid with a cloudy appearance which was apparently caused by gas bubbles. One hour after the agent was added, the iodide test was used to test for excess OXONE. Several crystals of potassium iodide were added to about 3 ml of distilled water in a small Erlenmeyer flask. The flask was swirled until all of the crystals dissolved, then about 3 ml of the decontaminated VX solution was added. An immediate iodine red color formed which indicated the presence of active oxygen. A 0.5 ml sample of the decontaminated agent was withdrawn for NMR analysis 195 minutes into the test. $^{31}P$ NMR indicated that all VX had been destroyed, however, a small amount of toxic by-product was present. At the end of 24 hrs, the pH was determined to be 1.2 using an Orion Research Model 811 pH Meter calibrated with standard buffers at pH 4.01 and 7.00. Also at 24 hrs, samples were again withdrawn for NMR and additional analysis as required. The remaining solution of decontaminated agent was titrated with stirring to pH 3 by slowly adding 50.8 g of solid NaOH. The final neutralization was with 46 ml of a 10 wt % aqueous solution of NaOH which raised the pH to 7. During neutralization, some solids precipitated from solution. To provide an even distribution of the solids, samples were withdrawn with mixing for NMR and GC analysis and toxicity tests. $^{31}P$ NMR analysis of neutralized and unneutralized samples drawn at 24 hrs indicated all of the VX was destroyed and no toxic by-product was present. GC analysis confirmed that all of the VX had been destroyed. The waste profile analysis of the neutralized product was performed and was negative except that the pH had dropped to 5.1. Toxicity tests consisting of dermal rabbit, oral rat, and inhalation rat were completed and the animals showed no toxic signs. Thus, the material was rated not a class "B" poison based on toxicity criteria.

What is claimed is:

1. A method of detoxifying phosphonothiolates and phosphonothioic acids, which comprises:

(a) reacting a composition comprising a phosphonothiolate or phosphonothioic acid with a sufficient amount of a compound containing an $HSO_5^-$ ion for a sufficient time and under conditions sufficient to produce a reaction product having less toxicity than the phosphonothiolate or phosphonothioic acid; and (b) subsequently hydrolyzing said reaction product under acid pH to produce an hydrolysis product.

2. The method of claim 1, further comprising the step of subsequently neutralizing said hydrolysis product with an hydroxide.

3. The method of claim 2, wherein said hydroxide is selected from the group consisting of sodium hydroxide and potassium hydroxide.

4. The method of claim 1, wherein the compound containing an $HSO_5^-$ ion is present in solution.

5. The method of claim 1, wherein said compound containing an $HSO_5^-$ ion is present in an aqueous solution.

6. The method of claim 1, wherein the compound containing an $HSO_5^-$ ion is present in an amount to provide at least three molar equivalents of active oxygen per molar equivalent of phosphonothiolate or phosphonothioic acid.

7. The method of claim 1, wherein the compound containing an $HSO_5^-$ ion is selected from the group consisting of potassium monopersulfate, sodium monopersulfate, ammonium monopersulfate, $HSO_5^-$ salts of alkali metals, and $HSO_5$-salts of alkaline earth metals.

8. The method of claim 1, wherein said compound containing an $HSO_5^-$ ion comprises $2KHSO_5.KHSO_4.K_2SO_4$.

9. The method of claim 1, wherein said phosphonothiolate is O-ethyl S-(2-diisopropylamino)ethyl methylphosphonothiolate.

10. The method of claim 1, wherein said phosphonothiolate is O-isobutyl S-(2-diethyl)ethyl methylphosphonothiolate.

11. The method of claim 1, wherein said phosphonothiolate is O,S-diethyl methylphosphonothiolate.

12. The method of claim 1, wherein said phosphonothioic acid is S-(diisopropylamino)ethyl methylphosphonothioic acid.

13. A method of detoxifying O-ethyl S-(2-diisopropylamino)ethyl methylphosphonothiolate, which comprises:

(a) reacting O-ethyl S-(2-diisopropylamino)ethyl methylphosphonothiolate with a sufficient amount of $KHSO_5.KHSO_4.K_2SO_4$ in water, for a sufficient time and under conditions sufficient to produce a reaction product having less toxicity than O-ethyl S-(2-diisopropylamino)ethyl methylphosphonothiolate; and (b) neutralizing said reaction product with an hydroxide.

14. The method of claim 13, wherein said hydroxide comprises an aqueous solution of an hydroxide selected from the group consisting of sodium hydroxide and potassium hydroxide.

* * * * *